US006280261B1

(12) United States Patent
Sakurai

(10) Patent No.: US 6,280,261 B1
(45) Date of Patent: Aug. 28, 2001

(54) RETAINING STRUCTURE OF CONNECTOR

(75) Inventor: Kazuaki Sakurai, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/542,288

(22) Filed: Apr. 4, 2000

(30) Foreign Application Priority Data

Apr. 5, 1999 (JP) ..... 11-098061

(51) Int. Cl.[7] ..... H01R 13/432
(52) U.S. Cl. ..... 439/746
(58) Field of Search ..... 439/746–749, 439/744, 871, 872

(56) References Cited

U.S. PATENT DOCUMENTS

| | | | | |
|---|---|---|---|---|
| 3,562,698 | | 2/1971 | Merry | 339/217 |
| 3,697,934 | | 10/1972 | Merry | 339/217 S |
| 4,040,713 | | 8/1977 | Konnemann | 339/259 R |
| 4,139,255 | * | 2/1979 | Otani | 439/748 |
| 4,589,721 | * | 5/1986 | Sedig et al. | 439/748 |
| 6,109,982 | * | 8/2000 | Okabe et al. | 439/748 |

FOREIGN PATENT DOCUMENTS

| | | |
|---|---|---|
| 53-2690 | 1/1978 | (JP) . |
| 6-86272 | 12/1994 | (JP) . |
| 7-22107 | 1/1995 | (JP) . |

* cited by examiner

*Primary Examiner*—Gary F. Paumen
(74) *Attorney, Agent, or Firm*—Sughrue, Mion, Zinn, Macpeak & Seas, PLLC

(57) ABSTRACT

A spring mechanism (6) is provided at a portion of a connector housing (2). The spring mechanism (6) includes an insertion port (8), a retaining projection (10) and a leaf spring (9) retained by the retaining projection (10). A spring holder (17) for resiliently deforming the leaf spring (9), is provided at a terminal portion (3) to be received in a receiving portion (4). When the terminal portion (3) is inserted into the receiving portion (4), the leaf spring (9) is resiliently deformed by the spring holder (17). As a result, the whole of the terminal portion (3) is urged by the leaf spring (9), and a resilient-retaining piece portion (16), provided at the terminal portion (3), is retainingly engaged in a retaining portion (5) formed at the receiving portion (4), thereby eliminating a clearance between the connector housing and the terminal portion.

9 Claims, 10 Drawing Sheets

RETAINING STRUCTURE OF CONNECTOR

BACKGROUND OF THE INVENTION

1. Field of the Invention

The present invention relates to a retaining structure of a connector for retaining a terminal portion in a connector housing of the connector without forming a clearance therebetween. In particular, the present invention relates to a retaining structure suited for a high-frequency coaxial connector used in the connection of a car wire harness.

The present application is based on Japanese Patent Application No. Hei. 11-98061, which is incorporated herein by reference.

2. Description of the Related Art

Various electronic equipments and parts are mounted on current automobiles, and wire harnesses and connectors have been used in the connection of such electronic equipments and so on. Various connectors are known, and such a related connector will be described with reference to FIGS. 9 to 13.

In this connector 31, a terminal portion 34 is inserted in a receiving portion 33, formed in a connector housing 32, and is retained against withdrawal therefrom. The terminal portion 34, shown in FIGS. 9 and 10, is formed by forming an electrically-conductive, resilient flat member (made, for example, of brass) into a generally trough-like shape. Wire clamping piece portions 36 are formed at one end of the terminal portion 34, and wire conductor-clamping portions 38 are formed generally at a central portion of the terminal portion 34, and are separated from the wire clamping piece portions 36 by notches 35, respectively. Notches 37 are formed immediately adjacent to front ends of the conductor clamping portions 38, respectively.

A pair of spring portions 39 are formed at the other end portion of the terminal portion 34, and are defined by opposite side wall portions of the other end portion, respectively. A slit is formed in a bottom wall portion 41, so that that portion of the bottom wall portion 41, disposed between the two spring portions 39, forms a resilient-retaining piece portion 42.

A wire 43 is inserted into the terminal portion 34 as shown in phantom in FIG. 10, and a conductor 43*a* of this wire is electrically connected to the terminal portion 34 by pressing the conductor clamping portions 38, and the wire 43 is fixedly secured to the terminal portion 34 by pressing the wire clamping piece portions 36.

As shown in FIG. 11, the terminal portion 34, having the wire 43 thus fixed thereto, is received in the hollow receiving portion 33 formed in the connector housing 32. At this time, the resilient-retaining piece portion 42 is once retracted to a plane, in which the bottom wall portion 41 lies, by a surface of the connector housing 32 as shown in FIG. 12, and then when the insertion of the terminal portion 34 further proceeds, so that the resilient-retaining piece portion 42 reaches an opening 32*a* in the connector housing, the resilient-retaining piece portion 42 is restored into its original shape as shown in FIG. 13.

As a result, the terminal portion 34 is received in the connector housing 32, and a mating terminal 44 is inserted between the spring portions 39, and is electrically connected thereto as shown in phantom in FIG. 10.

In the connector 31, the terminal portion 34 is inserted until the distal end of the terminal portion 34 is brought into engagement with an inner end surface 33*a* of the receiving portion 33, and the resilient-retaining piece portion 42 is retainingly engaged in the opening 32*a*, thereby preventing the terminal portion 34 from withdrawal from the connector housing 32. Therefore, in the assembled condition in which the terminal portion 34 is received in the receiving portion 33, a clearance L is formed between the resilient-retaining piece portion 42 and a side surface of the opening 32*a* as shown in FIG. 13.

Therefore, when the mating terminal 44 is inserted into the terminal portion 34 as described above, the terminal portion 34 is moved in accordance with the clearance L, thus causing a relative movement between the terminal portion and the connector housing.

In order to overcome this problem, there have been proposed a construction, in which an increased number of resilient-retaining piece portions are provided, and a construction in which the double retaining is effected. Referring to the construction, having an increased number of resilient-retaining piece portions, in connection with FIGS. 9 and 10, the resilient-retaining piece portions are formed respectively at outer surfaces of the wire clamping piece portions 36. With this construction, although a clearance in a transverse direction can be reduced, a clearance in a longitudinal direction can not be eliminated.

In the construction in which the double retaining is effected, a terminal portion is retained relative to a connector housing, and the terminal portion is retained relative to the connector housing by a completely-retaining member which is separate from or integral with the connector housing. In this construction, the retained condition, achieved by the completely-retaining member, is the completely-retained condition, and during the transfer and production of the connector, the terminal portion is held in a provisionally-retained condition without the use of the completely-retaining member. However, when the completely-retaining member is provided on the connector housing, there have been encountered problems that the completely-retaining member becomes obstructive during the transfer, that the connector fails to be set in an existing automatic wire harness-assembling apparatus, and that the terminal portion is completely retained by the completely-retaining member during the transfer.

The above connector 31 is designed to connect a wire of a power source or the like. There is also known the type of connector designed to connect a shielded wire. Such a shield connector is designed to connect conductors together and also to connect shielded wires together, and therefore has a larger number of component parts as compared with the above connector. Therefore, clearances between members increase a total clearance between a connector housing and a terminal portion, and because of this increased clearance, a relative movement between the terminal portion and the connector housing, occurring when connecting the mating connector to the terminal portion, is large.

SUMMARY OF THE INVENTION

With the above problems in view, it is an object of this invention to provide a retaining structure of a connector which can reduce a clearance between a connector housing and a terminal portion with a simple construction without increasing the number of component parts.

To achieve the above object, according to the first aspect of the present invention, there is provided a connector which comprises a connector housing including a receiving portion formed therein, a terminal portion insertable into the receiving portion of the connector housing, a spring attachable to the connector housing so as to project into the receiving portion, a spring holder formed on a first side surface of the terminal portion, the spring holder pressing the spring so that the spring is resiliently deformed when the terminal portion is inserted into the receiving portion, a resilient-retaining piece portion formed on a second side surface of the terminal portion, the resilient-retaining piece portion being slid on an inner surface of the receiving portion while being resiliently deformed when the terminal portion is inserted into the receiving portion, and a retaining portion formed in the receiving portion, wherein, when the terminal portion is inserted into a predetermined position within the receiving portion, a whole of the terminal portion is pushed by the spring so that the resilient-retaining piece portion is retained by the retaining portion.

Further, according to the second aspect of the present invention, it is preferable that the spring is resilient in an axial direction of the terminal portion inserted into the receiving portion.

Further, according to the third aspect of the present invention, it is preferable that when the terminal portion is inserted into the predetermined position within the receiving portion, the whole of the terminal portion is pushed by the spring in a direction opposite to an inserting direction of the terminal portion.

Further, according to the fourth aspect of the present invention, it is preferable that the connector further comprises a step portion formed on the inner surface of the receiving portion, the step portion having a slanting surface, wherein when the terminal portion is inserted into the receiving portion, the resilient-retaining piece portion is slid on the slanting surface of the step portion, and goes beyond the step portion, and then is retained by the retaining portion.

Further, according to the fifth aspect of the present invention, it is preferable that a part of the step portion defines the retaining portion.

Further, according to the sixth aspect of the present invention, it is preferable that the connector further comprises a spring mechanism integrally formed in the connector housing, the spring mechanism including the spring, an insertion port into which the spring is inserted from an outer side of the connector housing, and a retaining projection retaining one end of the spring while the other end of the spring is resiliently movable.

Further, according to the seventh aspect of the present invention, it is preferable that the retaining projection retains one end of the spring while the other end of the spring is resilient in an axial direction of the terminal portion inserted into the receiving portion.

Further, according to the eighth aspect of the present invention, it is preferable that the spring has a substantially U-shape.

In the connector, when the terminal portion is inserted into the receiving portion formed in the connector housing, the spring, fixed by the spring mechanism, is pressed to be resiliently deformed by the spring holder provided at the terminal portion. The resilient-retaining piece portion of the terminal portion, is resiliently deformed so as to be retainingly engaged with the retaining portion when the terminal portion is inserted into the predetermined position in the receiving portion. At this stage, the whole of the terminal portion is pushed by the restoring force of the spring, so that the resilient-retaining piece portion is brought into retaining engagement with the retaining portion, thereby eliminating a clearance between the connector housing and the terminal portion.

DETAILED DESCRIPTION OF THE PREFERRED EMBODIMENT

A retaining structure of a connector, embodying the present invention, will now be described with reference to FIGS. 1 to 8.

First, the construction of a retaining structure 1 of the connector will be described.

Figure 1:
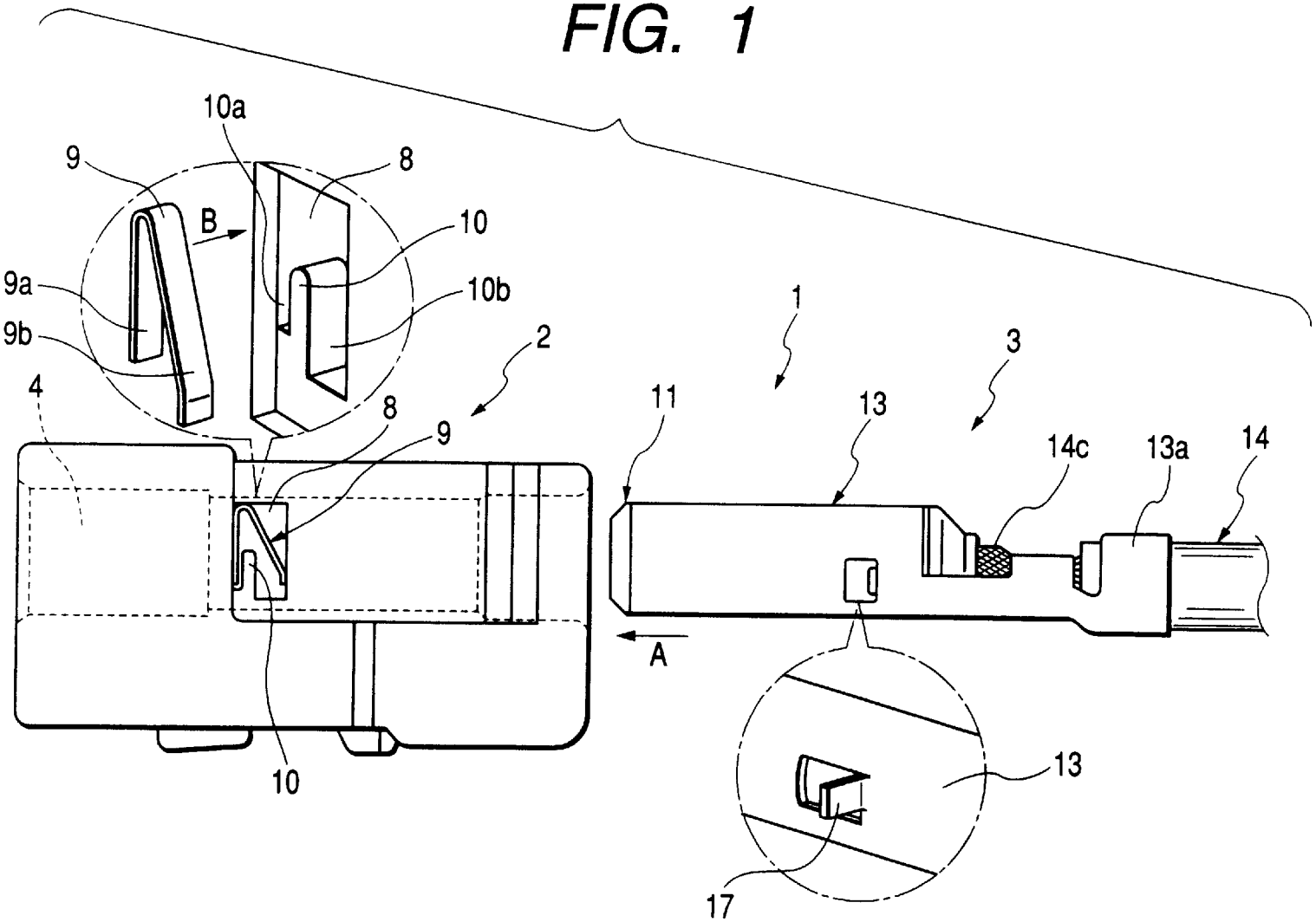
FIG. 1 is a side-elevational view, showing a preferred embodiment of a connector of the present invention.
Figure 2:
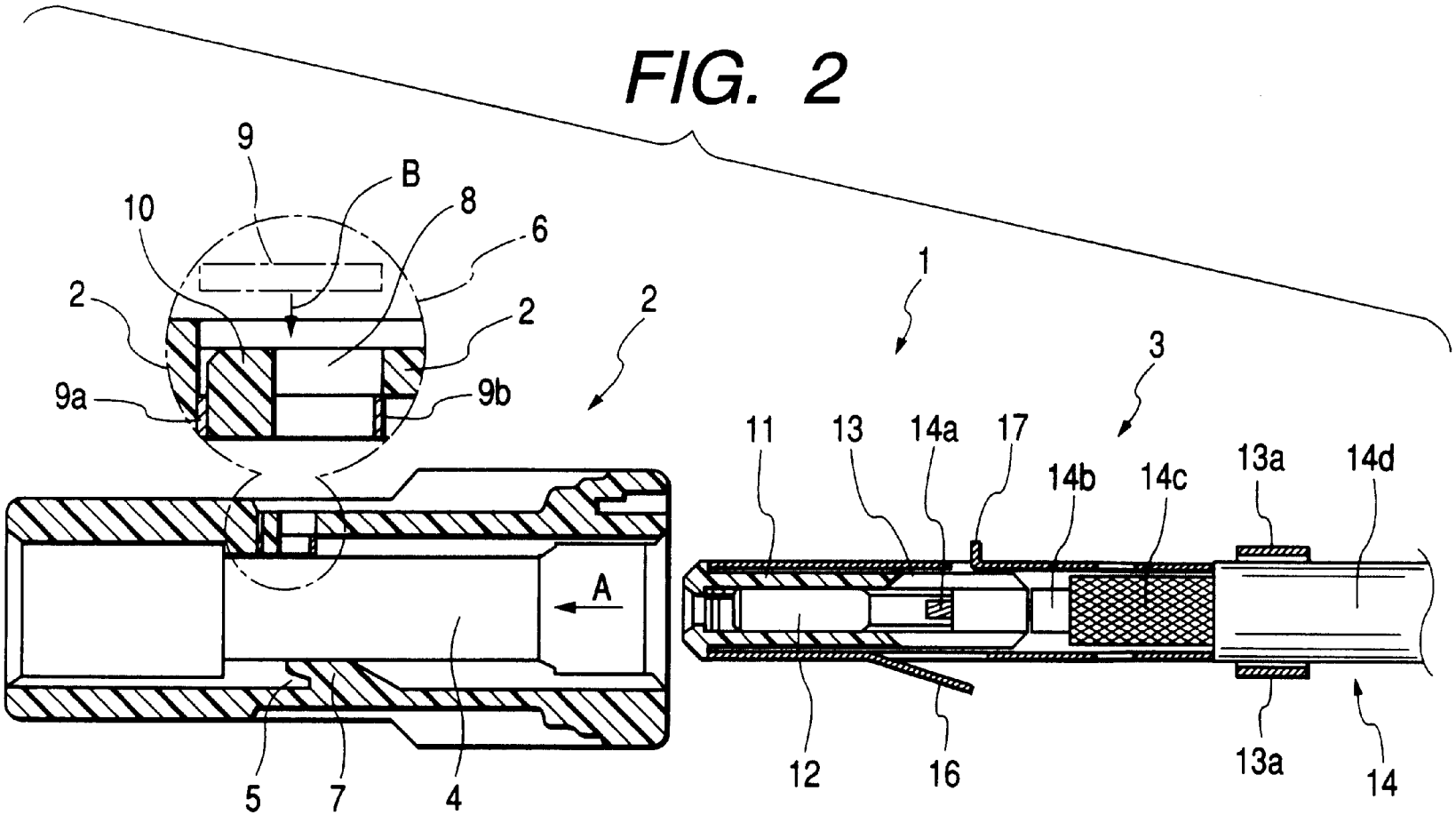
FIG. 2 is a cross-sectional view showing the construction of the connector.

The retaining structure 1 of the connector comprises a connector housing 2 (shown left in FIG. 1), and a shield terminal assembly (hereinafter referred to as "terminal portion") 3 shown right in FIG. 1. As shown in FIG. 2, a longitudinal receiving portion 4 is formed within the connector housing 2, and the terminal portion 3 can be inserted into this receiving portion 4 in a direction of arrow A. The inserted terminal portion 3 is retained in the receiving portion 4, and in this embodiment the terminal portion 3 is not merely retained, but such an arrangement is made that the terminal portion 3 is retained without forming a clearance.

The retaining without a clearance is effected by the cooperation of the terminal portion 3 with the receiving portion 4. First, the construction of the receiving portion 4 will be described.

As shown in FIG. 2, a recess-like retaining portion 5 is formed in one side surface of the receiving portion 4, and a spring mechanism 6 is provided at that surface of the receiving portion 4 opposed to the retaining portion 5. The main function of the retaining portion 5 is to retain the terminal portion 3, and the main function of the spring mechanism 6 is to eliminate a clearance of the retained terminal portion 3.

The notch-like retaining portion 5 is formed in a rear side (as viewed in the direction of arrow A) of a step portion 7 formed on the inner surface of the receiving portion 4.

The spring mechanism 6 includes an insertion port 8, formed in a side wall of the connector housing 2, and a leaf spring 9 of a generally V-shape inserted in this insertion port 8. As shown in FIG. 1, the insertion port 8 is elongate in a vertical direction, and a retaining projection 10 is formed within the insertion port 8. The leaf spring 9 is inserted into the insertion port 8 in a direction of arrow B, and one end portion 9*a* of the leaf spring 9 is fixedly fitted in a narrow space 10*a* formed between a side surface of the insertion port 8 and the retaining projection 10. The other end portion 9*b* of the leaf spring 9 is inserted in a wide space 10*b* formed between a side surface of the insertion port 8 and the retaining projection 10.

In this construction, the leaf spring 9 is fixedly provided in the insertion port 8, and projects into the receiving portion 4 in such a manner that the other end portion 9*b* is resiliently deformable within the space 10*b*.

Referring to the terminal portion 3, an inner terminal 12 is provided within a cylindrical inner housing 11, and the inner housing 11 is covered with a shield terminal 13. The inner terminal 12 serves as a connection terminal for connection to a mating terminal (not shown), and the shield terminal 13 performs a magnetic shielding function.

A conductor 14*a* of a shielded wire 14 is fixedly connected to one end of the inner terminal 12 by pressing or the like. A shield braid 14*c*, covering an insulating sheath 14*b* covering the conductor 14*a*, is electrically connected to the shield terminal 13 by pressing. The shielded wire 14 (and hence an outer sheath 14*d* thereof) is fixedly secured to the shield terminal 13 by pressing a bulk portion 13*a* formed at one end of the shield terminal 13. Therefore, the shielded wire 14, the shield terminal 13, the inner terminal 12 and the inner housing 11 are united together to form the terminal portion 3 having a shielding function.

In the terminal portion 3, the function of retaining the terminal portion relative to the connector housing 2, as well as the clearance-eliminating function, is provided at the shield terminal 13. More specifically, the resilient-retaining piece portion 16 for retaining engagement in the retaining portion 5 is formed on the outer surface of the shield terminal 13, and a spring holder 17 is formed on the outer surface of the shield terminal 13. The spring holder 17 resiliently deforms the leaf spring 9 during the insertion of the terminal portion into the connector housing 2, and after this insertion, the spring holder 17 is urged by the leaf spring.

Figure 3:
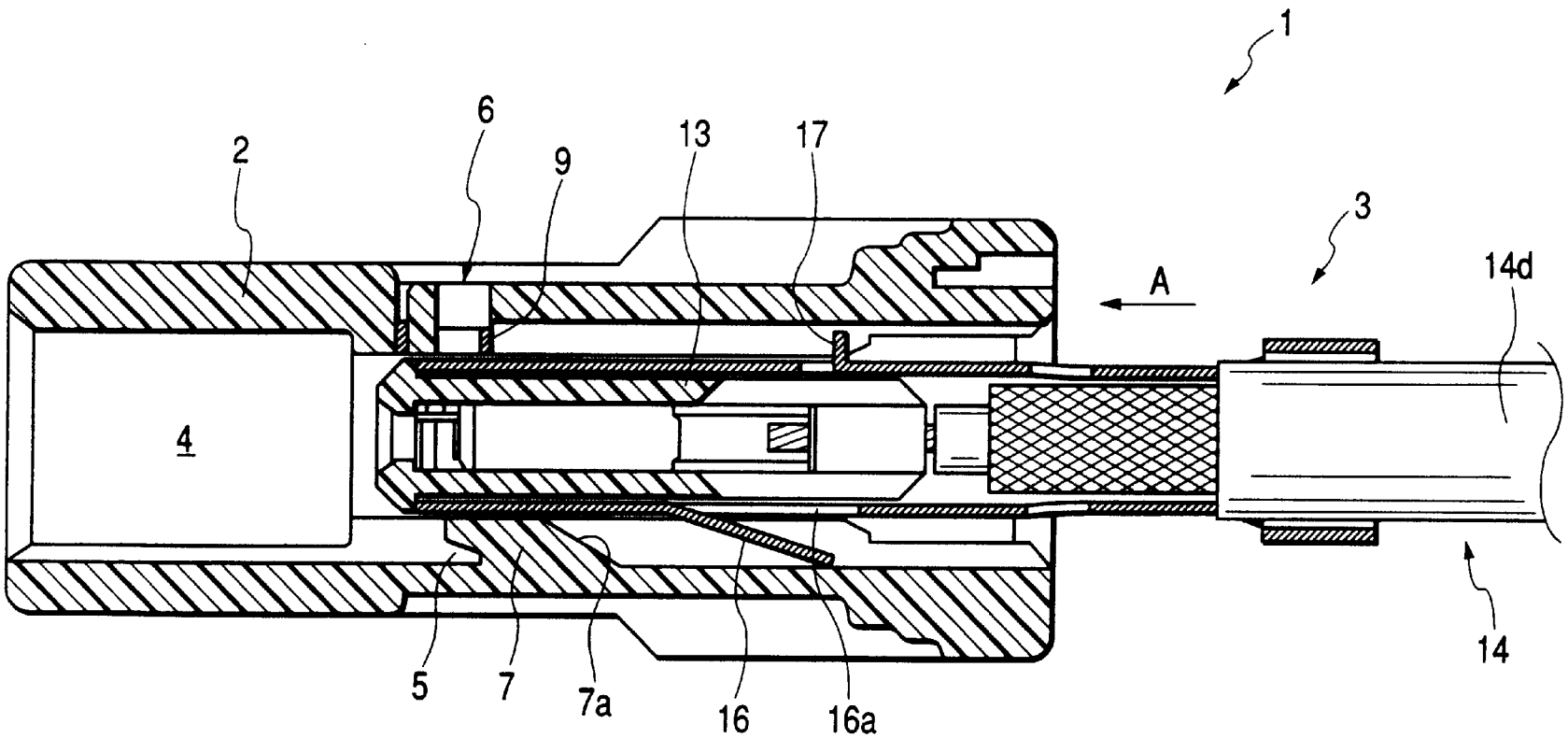
FIG. 3 is a cross-sectional view showing a connector-assembling operation.

Next, the assembling operation of the connector 1, the retaining of the terminal portion 3 by the connector housing 2, and a clearance will be described with reference to infra FIG. 3.

The connector 1 comprises the connector housing 2 and the terminal portion 3, and for mounting the terminal portion 3 in the connector housing 2, the terminal portion 3 is inserted into the receiving portion 4 in the direction of arrow A. At an initial stage of this inserting operation, the resilient-retaining piece portion 16 is not deformed as shown in FIG. 3. As the insertion of the terminal portion 3 proceeds, the resilient-retaining piece portion 16 slides on a slanting surface 7*a* of the step portion 7, and is gradually deformed into a flattened condition.

When the terminal portion is further inserted in the direction of arrow A, the resilient-retaining piece portion 16 is pressed by the step portion 7, and is forcibly received in a slot 16*a* formed as a result of stamping the resilient-retaining piece portion 16. As a result of reception of the terminal portion 3, the spring holder 17 approaches the leaf spring 9, but is not yet in contact with the leaf spring. 9 at this stage.

Figure 4:
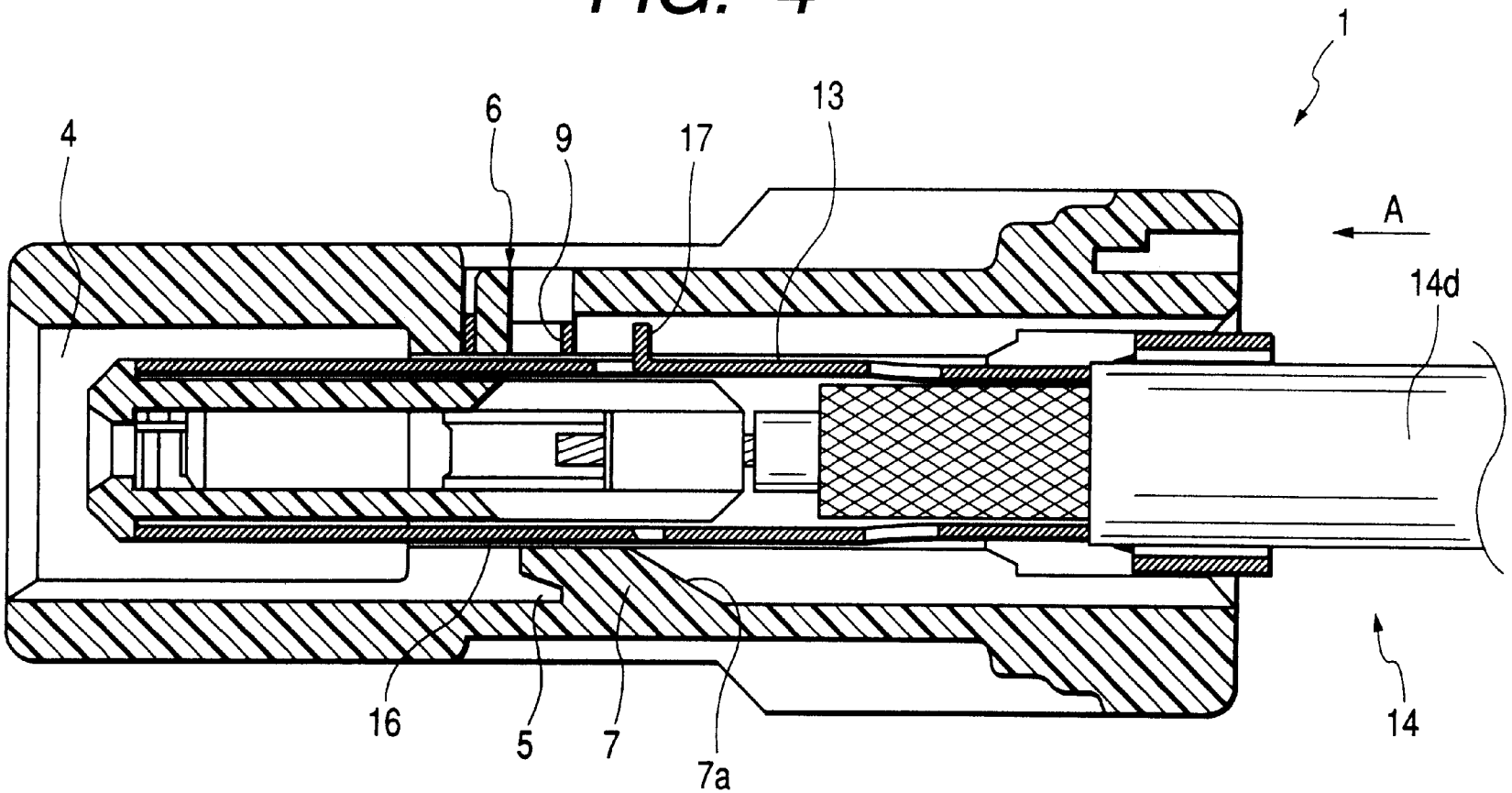
FIG. 4 is a cross-sectional view showing the connector-assembling operation.
Figure 5:
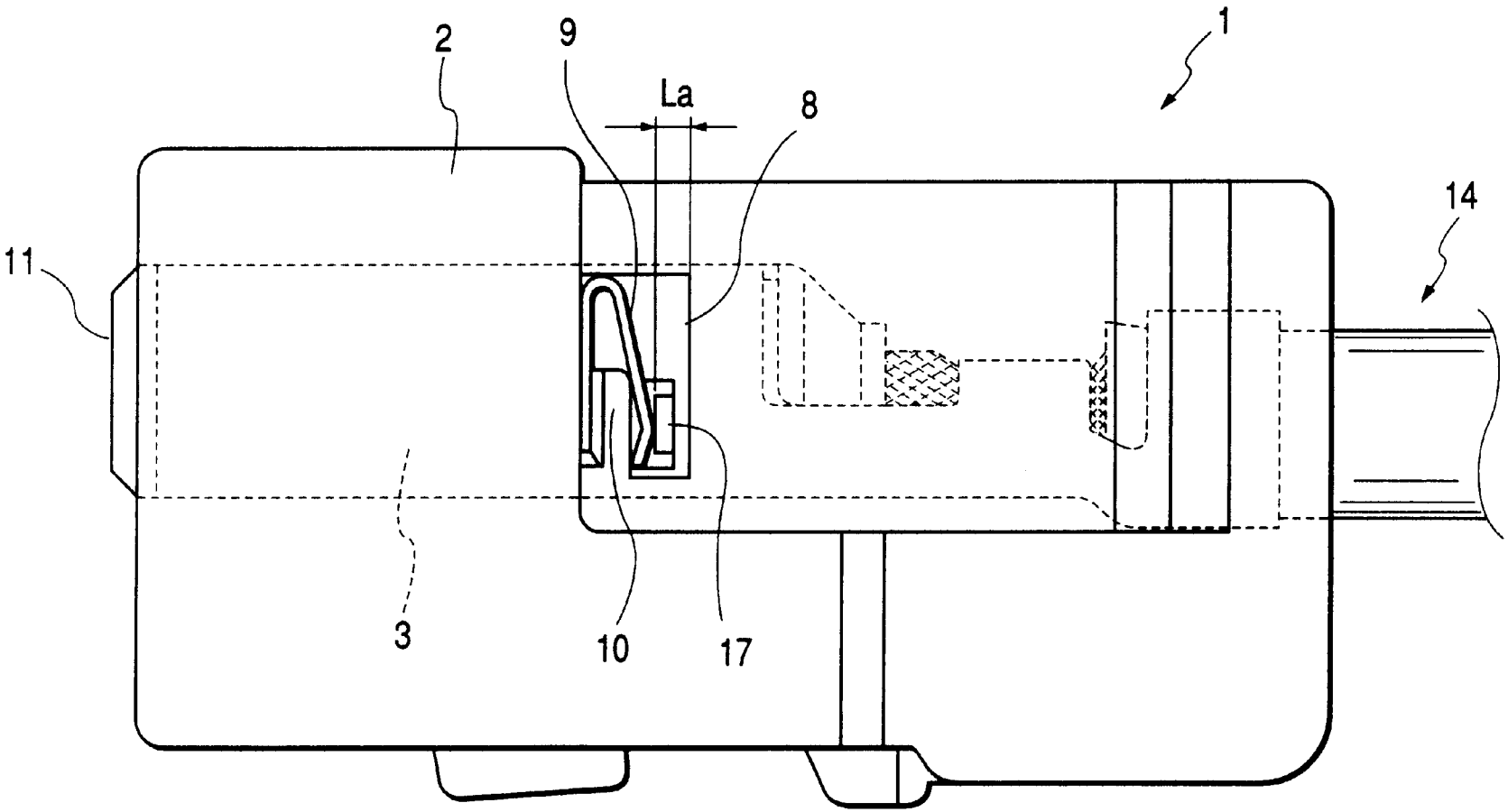
FIG. 5 is a side-elevational view of the connector, showing the compression of a spring member.
Figure 6:
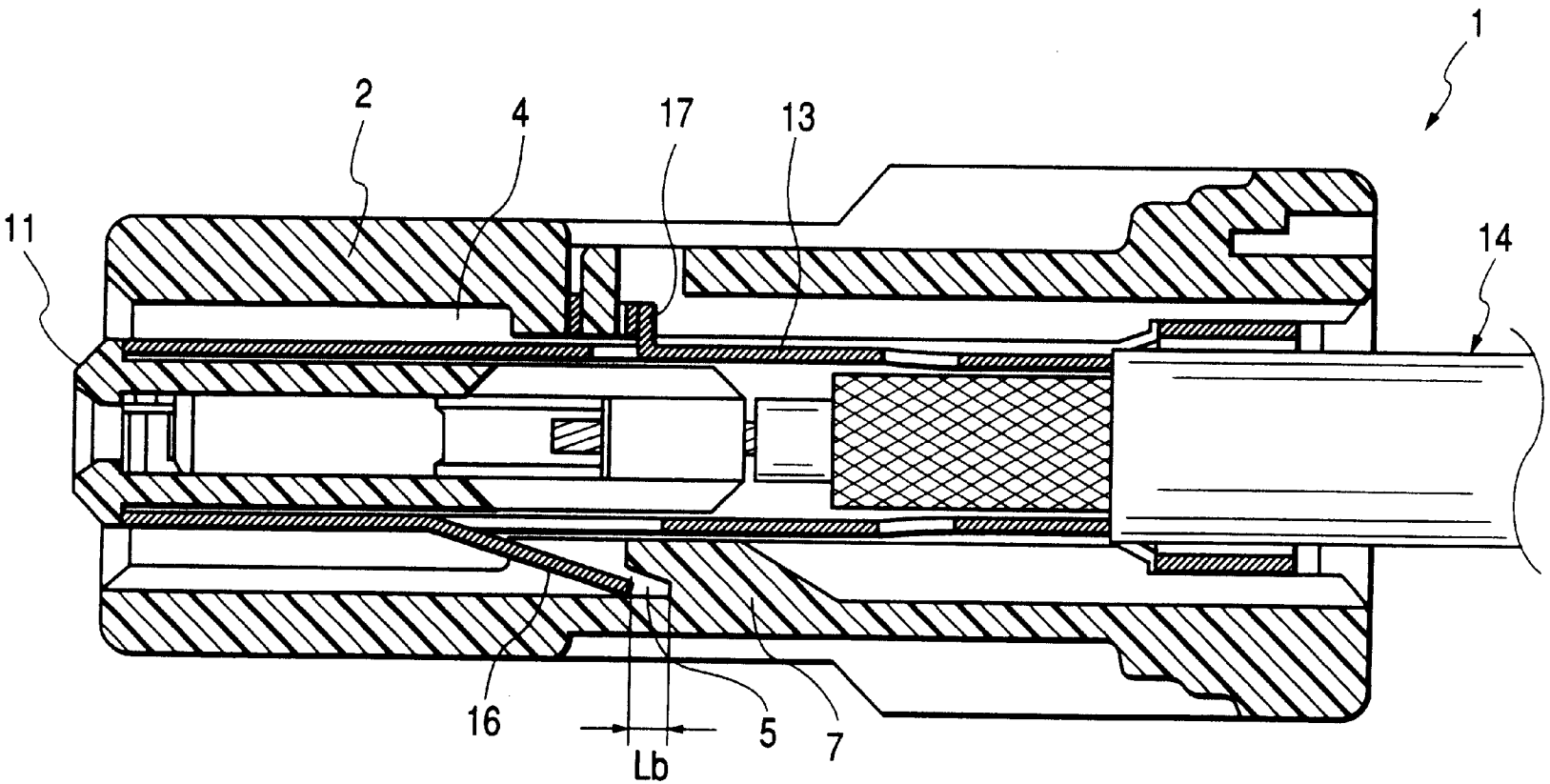
FIG. 6 is a cross-sectional view showing the compression of the spring member.

When the terminal portion 3 is further inserted from the position shown in FIG. 4, the resilient-retaining piece portion 16 slides past the step portion 7, and at the time when the distal end of the resilient-retaining piece portion 16 slides past the step portion 7, the resilient-retaining piece portion 16 is restored into its original shape because of its own resiliency as shown in FIG. 6. On the other hand, the spring holder 17 presses the leaf spring 9 to resiliently deform the same as shown in FIGS. 5 and 6.

When the resilient-retaining piece portion 16 is restored into its original shape, the resistance to the insertion of the terminal portion 3 is reduced, and it can be confirmed from this that the terminal portion 3 has been properly inserted into the receiving portion 4. Here, it is to be noted that the distal end of the terminal portion 3 projects from the front end of the connector housing 2. In the related connector 31, the receiving portion 33 has the inner end surface 33*a* for preventing the terminal portion from being disengaged from the receiving portion 33. In this embodiment, however, there is no need to provide such an inner end surface of the receiving portion.

Figure 7:
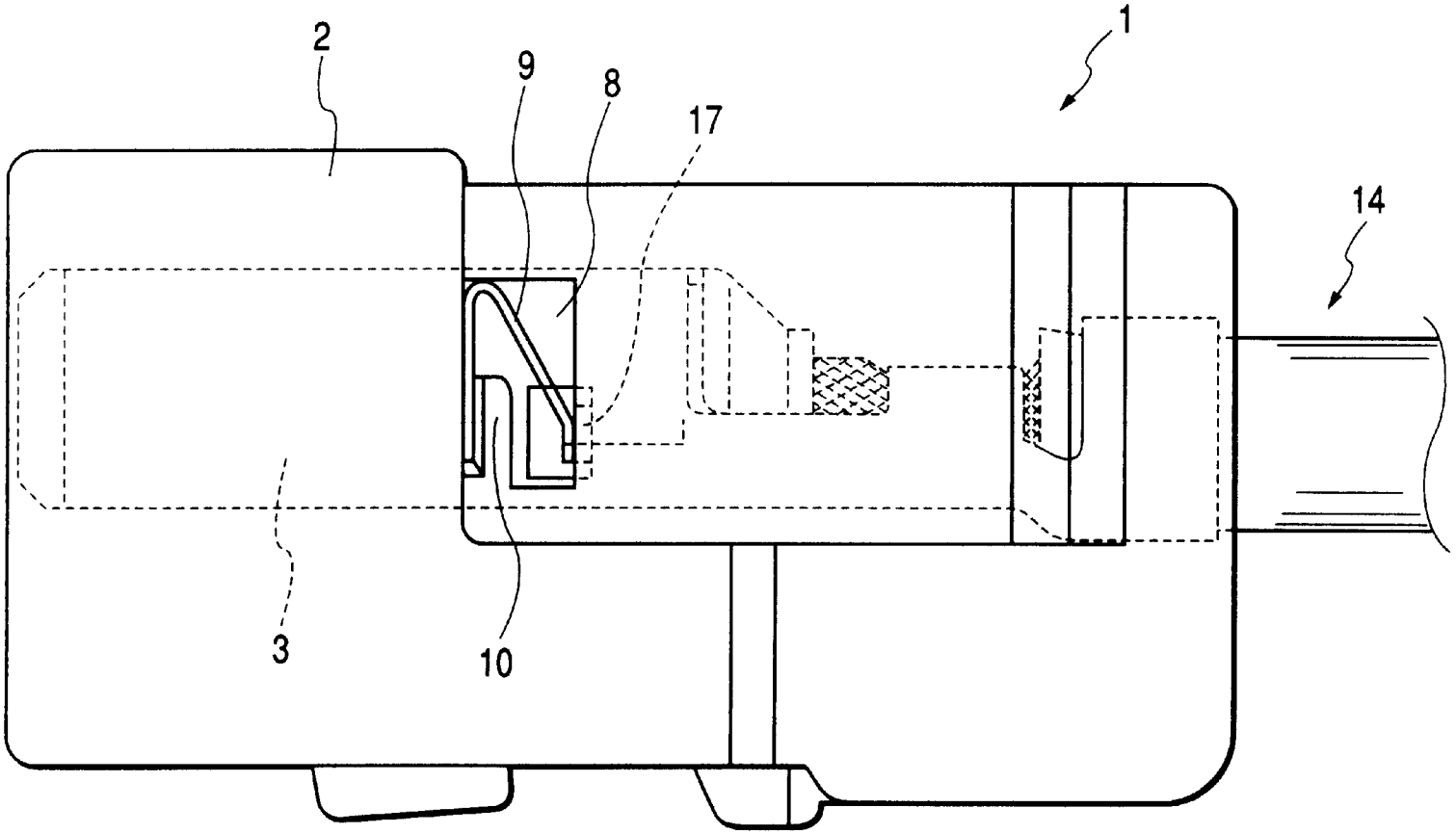
FIG. 7 is a side-elevational view of the connector, showing a restoring action of the spring member.

When the insertion of the terminal portion 3 in the direction of arrow A is stopped at this stage, the force, which has resiliently deformed the leaf spring 9, is removed, so that the leaf spring 9 is restored from the shape, shown in FIG. 5, into its original shape shown. in FIG. 7. As a result, the whole of the terminal portion 3 is urged in a direction opposite to the direction of arrow A by the restoring force of the leaf spring 9, and is pushed back in an amount corresponding to the amount La of displacement of the leaf spring 9.

However, the resilient-retaining piece portion 16 has already slid past the step portion 7, and therefore when the terminal portion 3 is thus pushed back, the resilient-retaining piece portion 16 is brought into retaining engagement with the retaining portion 5, and therefore can not be further pushed back. As a result, the distal end of the terminal portion 3, which has projected from the front end of the connector housing 2, is retracted into the receiving portion 4 as shown in FIGS. 7 and 8, thus completing the mounting of the terminal portion 3 in the connector housing 2.

Figure 8:
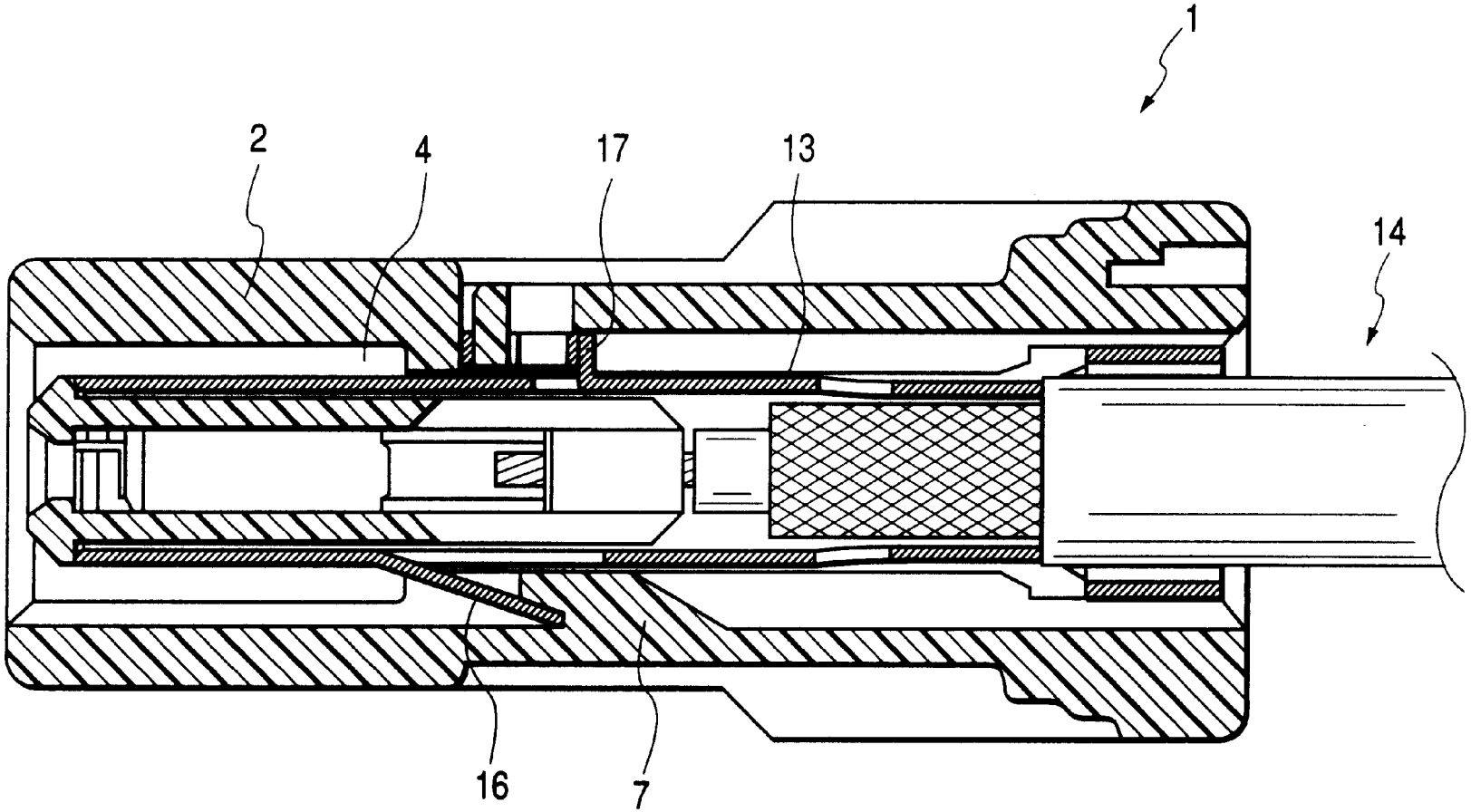
FIG. 8 is a cross-sectional view showing a retained condition of a resilient-retaining piece portion.
Figure 9:
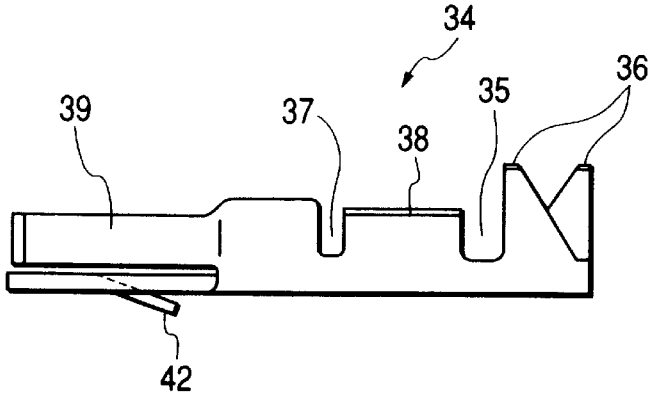
FIG. 9 PRIOR ART
FIG. 9 is a side-elevational view showing a terminal portion of a related connector.
Figure 10:
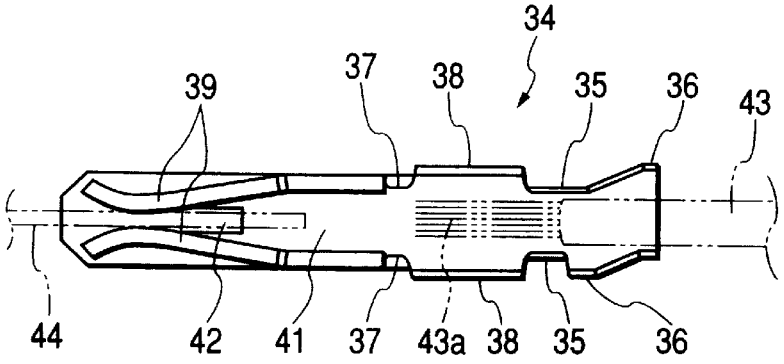
FIG. 10 PRIOR ART
FIG. 10 is a plan view of the terminal portion.
Figure 11:
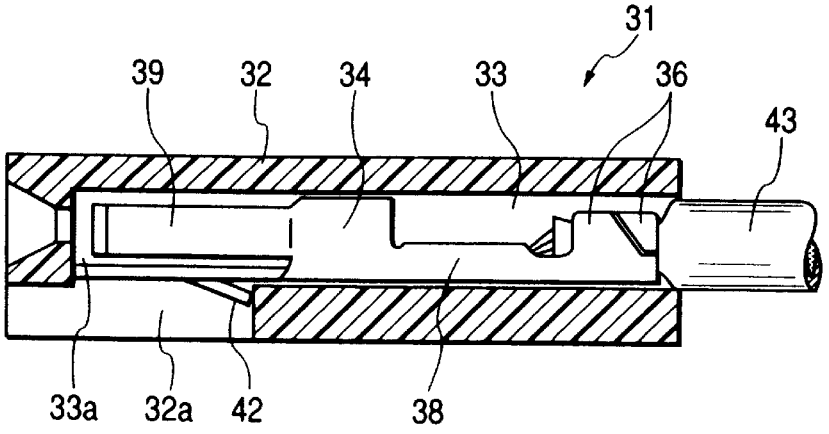
FIG. 11 PRIOR ART
FIG. 11 is a cross-sectional view of the related connector.
Figure 12:
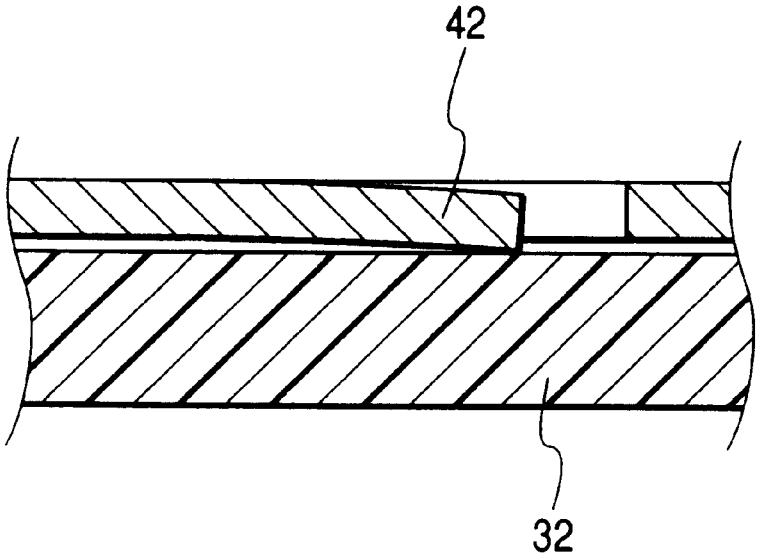
FIG. 12 PRIOR ART
FIG. 12 is a cross-sectional view showing the deformation of a resilient-retaining piece portion.
Figure 13:
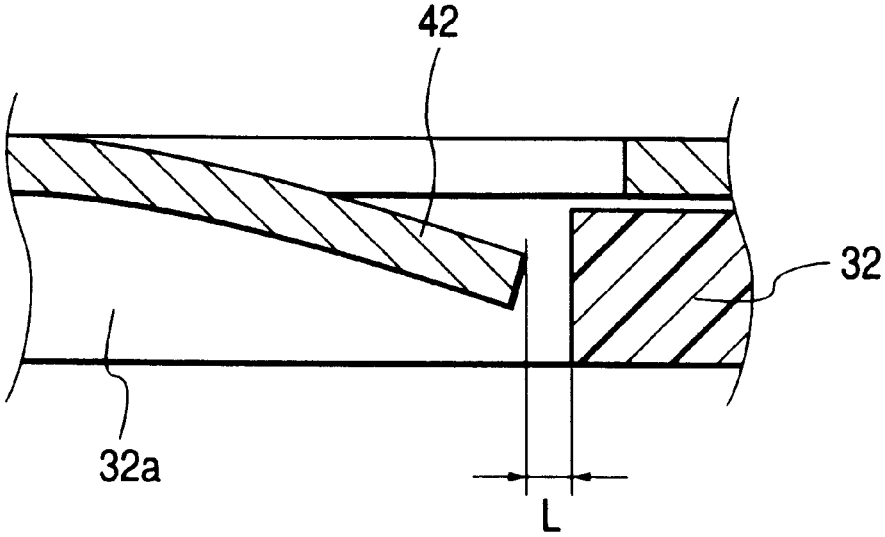
FIG. 13 PRIOR ART
FIG. 13 is a cross-sectional view showing a retaining operation of the resilient-retaining piece portion.

When the terminal portion 3 is thus mounted in the connector housing 2, the distal end of the terminal portion 3, which has projected from the front end of the connector housing 2, is retracted into the receiving portion 4 as; shown in FIGS. 7 and 8. The relation between an engagement amount Lb of the retaining portion 5 and the amount La of displacement of the leaf spring is so determined that $La \geqq Lb$ is established, and the terminal portion 3 is always urged by the leaf spring 9. Therefore, the receiving portion 4 does not need to have an inner end surface for preventing the disengagement of the terminal portion 3 from the connector housing, and there is no need to provide a clearance resulting from the formation of such an inner end surface.

In the retaining structure 1 of the connector, when the terminal portion 3 is properly received in the receiving portion 4, the whole of the terminal portion 3 is urged by the leaf spring 9, so that the resilient-retaining piece portion 16 never fails to be retainingly engaged in the retaining portion 5. The terminal portion 3 is always urged by the leaf spring 9, and therefore the terminal portion 3 will not move within the connector housing 2. When the mating terminal is to be connected to the terminal portion 3, the terminal portion 3 is pressed by this mating terminal, but will not move relative to the connector housing since there exists no clearance.

And besides, any separate retaining member for eliminating a clearance does not need to be provided exteriorly of the connector housing, and a provisionally-retaining operation and a completely-retaining operation do not need to be effected. Furthermore, the outer size of the connector is not increased, and any member does not project outwardly from the connector, and the transfer of the connector is easy, and the connector can be set in an existing automatic wire harness-assembling apparatus.

Although the above embodiment is directed to the shield connector, the present invention can be applied to an ordinary wire connector.

In the above embodiment, although the leaf spring of a generally V-shape is used, this V-shaped leaf spring can be replaced by a generally U-shaped leaf spring, a straight leaf spring, a coil spring or the like.

As described above, in the retaining structure of the connector, when the terminal portion is inserted into the receiving portion formed in the connector housing, the spring, fixed by the spring mechanism, is pressed to be resiliently deformed by the spring holder provided at the terminal portion, and the resilient-retaining piece portion, provided at the terminal portion, is resiliently deformed so as to be retainingly engaged with the retaining portion, provided at the receiving portion, and the whole of the terminal portion is pushed by the restoring force of the spring, so that the resilient-retaining piece portion is brought into retaining engagement with the retaining portion.

Therefore, when the terminal portion is inserted into the receiving portion formed in the connector housing, a clearance between the connector housing and the terminal portion is eliminated, and a relative movement between the terminal portion and the connector housing will not occur when connecting the mating connector to the terminal portion. The terminal portion is always urged by the spring, and therefore the terminal portion will not be disengaged from the receiving portion, and an inner surface for preventing this disengagement does not need to be provided at the receiving portion, and therefore the structure can be simplified.

What is claimed is:

1. A connector, comprising:

a connector housing including a receiving portion formed therein;

a terminal portion insertable into the receiving portion of the connector housing;

a spring attachable to the connector housing so as to project into the receiving portion;

a spring holder formed on a first side surface of the terminal portion, the spring holder pressing the spring so that the spring is resiliently deformed when the terminal portion is inserted into the receiving portion;

a resilient-retaining piece portion formed on a second side surface of the terminal portion, the resilient-retaining piece portion being slid on an inner surface of the receiving portion while being resiliently deformed when the terminal portion is inserted into the receiving portion; and a retaining portion formed in the receiving portion, wherein, when the terminal portion is inserted into a predetermined position within the receiving portion, a whole of the terminal portion is pushed by the spring so that the resilient-retaining piece portion is retained by the retaining portion.

2. The connector of claim 1, wherein the spring is resilient in an axial direction of the terminal portion inserted into the receiving portion.

3. The connector of claim 1, wherein when the terminal portion is inserted into the predetermined position within the receiving portion, the whole of the terminal portion is pushed by the spring in a direction opposite to an inserting direction of the terminal portion.

4. The connector of claim 1, further comprising a step portion formed on the inner surface of the receiving portion, the step portion having a slanting surface, wherein when the terminal portion is inserted into the receiving portion, the resilient-retaining piece portion is slid on the slanting surface of the step portion, and goes beyond the step portion, and then is retained by the retaining portion.

5. The connector of claim 4, wherein a part of the step portion defines the retaining portion.

6. The connector of claim 1, further comprising a spring mechanism integrally formed in the connector housing, the spring mechanism including:

the spring, an insertion port into which the spring is inserted from an outer side of the connector housing, and a retaining projection retaining one end of the spring while the other end of the spring is resiliently movable.

7. The connector of claim 6, wherein the retaining projection retains one end of the spring while the other end of the spring is resilient in an axial direction of the terminal portion inserted into the receiving portion.

8. The connector of claim 7, wherein the spring has a substantially U-shape.

9. The connector of claim 2, wherein the spring has a substantially U-shape.

* * * * *